US006179152B1

(12) United States Patent
Sarnowski

(10) Patent No.: US 6,179,152 B1
(45) Date of Patent: Jan. 30, 2001

(54) ARTICLE ORGANIZER

(76) Inventor: Paul Douglas Sarnowski, 5841 W. Kesler St., Chandler, AZ (US) 85226

( * ) Notice: Under 35 U.S.C. 154(b), the term of this patent shall be extended for 0 days.

(21) Appl. No.: 09/311,073

(22) Filed: May 13, 1999

(51) Int. Cl.[7] ..... B65D 1/24
(52) U.S. Cl. ..... 220/549; 220/550
(58) Field of Search ..... 220/549, 550

(56) References Cited

U.S. PATENT DOCUMENTS 1,051,108 * 1/1913 Hemstreet ..... 220/550
1,069,477 * 8/1913 Sampson ..... 220/550
1,438,385 * 12/1922 Lehman ..... 220/550
1,820,888 * 8/1931 Rand ..... 220/550
2,332,472 * 10/1943 Roth ..... 220/550
2,669,236 * 2/1954 Straubel ..... 220/550
3,057,358 * 10/1962 Bergman ..... 220/550
3,126,892 * 3/1964 French ..... 220/550
3,547,311 * 12/1970 Van Buren ..... 220/550
3,889,838 * 6/1975 Kanitz ..... 220/550

* cited by examiner

*Primary Examiner*—Joseph M. Moy
(74) *Attorney, Agent, or Firm*—Gregory J. Nelson

(57) ABSTRACT

An organizer for maintaining items such as mail in a convenient, readily accessible generally stacked condition. The organizer has a receptacle tray with a retainer which is angularly disposed within the tray and longitudinally slidable therein along a track. A foot on the retainer is held in frictional engagement with the track or bottom of the organizer by the contents held between the retainer and an end of the tray. The user may easily disengage the retainer and move it in either direction by manually applying a counter force to the upper edge of the retainer. In the preferred embodiment, the tray is a standard postal tray of light weight material. In an alternate embodiment, an optional return spring may be provided to urge the retainer into engagement with the retained contents of the tray.

9 Claims, 2 Drawing Sheets

ARTICLE ORGANIZER

FIELD OF THE INVENTION

The present invention relates to an organizer and more particularly relates to an organizer receptacle for securing and maintaining items such as mail in an organized, accessible manner allowing the user to remove or insert items.

BACKGROUND OF THE INVENTION

Mail is generally automatically sorted by an operation termed "delivery point sequence". Mail is generally placed in a postal tray which is transported along the delivery route in a postal delivery vehicle. As the postal delivery person reaches a delivery location, the mail addressed to that location is removed from the tray and delivered. As the mail is removed from the conventional postal tray, the remaining mail items can become disorganized as the removed mail will cause the remaining mail to no longer remain upright in an organized manner but will fall to a flat position on the bottom of the tray.

The conventional postal tray is generally rectangular having an open top with openings at either end which serve as handles. The material of the tray is generally a light weight corrugated material and several official tray designs are in use which are designated the "EMM" and "MM". While these postal trays work well, are light weight and convenient to use in a delivery vehicle, the conventional trays have the disadvantage that the flat mail, letters, and the like are not maintained in a convenient upright position but rather may often assume a flat position making it necessary for the delivery personnel to manually search through the remaining mail for the items to be delivered to the next succeeding mail patron. This can occur if the trays are only partially filled during the initial sorting operation and also occurs as filled trays are emptied during the delivery operation.

A number of approaches to solving the problem dealing with conveniently maintaining mail in an easily accessible position can be found in the prior art. In some cases, individual postal delivery personnel may carry some type of cardboard or wood separator which are used to assist in maintaining the mail in a generally vertical position.

There are various approaches to organizing mail for delivery which can also be found within the patent literature. U.S. Pat. No. 4,643,306 teaches a postal tray provided with individual tray dividers for sorting and delivery of the mail.

Similarly, U.S. Pat. No. 3,491,909 teaches a method and apparatus of separating a tray or enclosure into individual compartments.

Benoit in U.S. Pat. No. 3,746,181 shows a series of individual separators each separator having a base portion. The base portion of the separator is loaded with articles to maintain it in place. This type of separator is designed for static storage of articles.

U.S. Pat. No. 4,889,397 shows a mail delivery system including a plurality of portable trays each having a bottom, an open top and at least two rigid and oppositely disposed sides affixed to the bottom, at least one open side and a gate member to open and close the open side. Separators are removably attached to at least the bottom. Regularly spaced slots within the bottom receive the separators. At least one set of handle members assist in the transportation of the portable tray and assist in the withdrawal or insertion of the portable tray from holder members arranged to receive the tray. A tray case containing a plurality of holder members to removably receive the plurality of portable trays, members for raising and lowering the case and the trays from the loading position to a sorting position are provided. A transport member containing a plurality of holder members to receive the portable trays and transport the portable trays from the tray cases to a tray rack are provided in a delivery vehicle.

A mail sorting rack is shown in U.S. Pat. No. 4,484,685 which has a rack structure with a plurality of parallel divider blades between which the postal worker inserts mail pieces for various addresses in order. A tray underlies the mail which enables the mail worker to pull the tray free of the extending blades eliminating the dividers from the sorted mail so the worker may more easily group and band them for delivery.

U.S. Pat. No. 5,207,347 shows a postal tray adjustable organizer having a translucent framework having an upright and flat bottom portion slidably affixed within the cavity of the postal tray. A finger-operated spring loaded shaft extends outwardly against the sides of the postal tray. The user may grasp the release handles of the spring loaded shaft and the organizer may be slid forward along the tray to secure the mail in an upright position.

Therefore, while the prior art suggests various approaches to the problem of maintaining mail in an organized, easily-identifiable arrangement, these prior art arrangements have not generally been embraced by the Post Office department for a number of reasons. Many of these devices are cumbersome, impair the visual identification of the mail. Further shortcomings of prior art devices is that they do not adapt themselves for use with the conventional light weight, flexible postal trays which are in use today such as the EMM and MM trays.

SUMMARY OF THE INVENTION

It is an object of the present invention to provide an organizer receptacle for documents and more particularly to an improved postal tray for use by postal personnel which tray will maintain the mail items in an organized, orderly and upright fashion and allowing easy removal of mail items during the delivery route.

The present invention provides a postal organizer having an article receptacle with a bottom, opposite sides and ends extending upwardly from the bottom and having an open top. Preferably the configuration of the receptacle and side walls permit the receptacles to be easily stacked when empty.

An elongated track extends within the bottom of the receptacle at least partway between the opposite ends at an intermediate location between the sides. A retainer, which is preferably generally a planar plastic panel, has a slide on its bottom side. The slide is engageable in the track so that the divider may be moved longitudinally within the receptacle to maintain items in an upright position between one side of the divider and one end of the tray. A foot extends from the lower end of the retainer. In the normal position, the retainer is inclined so that mail items abutting the side of the panel which forms an acute angle with respect to the bottom of the tray will impose a slight rotative force on the retainer causing the foot to engage either the track or the bottom of the receptacle, resulting in a frictional force which prevents unintended movement of the retainer. To move the retainer, the user may simply apply a slight opposite rotative force to the retainer to disengage the foot allowing it to be freely moved to accept additional letter items or to compact those items remaining after items have been removed. In an alternate embodiment, a spring may be provided extending between the slide and one end of the receptacle.

The organizer of the present invention may be utilized with a conventional postal tray such as those in use by the Post Office department or may be a specially fabricated item. A false floor may be provided overlying the bottom if the device is used in connection with a conventional postal tray. Also, a stop may be provided to limit the movement of the divider in one direction.

BRIEF DESCRIPTION OF THE DRAWINGS

The present invention will be more fully understood from the following description, taken in conjunction with the accompanying drawings in which.

DESCRIPTION OF THE PREFERRED EMBODIMENTS

Figure 6:
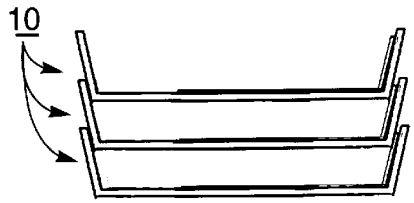
FIG. 6 is a cross-sectional view showing a plurality of organizers in a stacked, nested condition.

Referring to the drawings, the organizer of the present invention is generally designated by the numeral 10 and has a generally rectangular bottom 12, opposite sides 14 and 16, opposite ends 18 and 20 which generally define a tray-like receptacle having an open top and defining a compartment 22 for receipt of items such as mail. Preferably, the side walls and end walls extend upwardly and diverge slightly outward from the bottom wall 12 so the plurality of organizers as shown in FIG. 6 may be easily stored and stacked in a nested condition. In this way, separation of an organizer from a stack of nested organizers is facilitated.

The opposite end walls 18 and 20 are each provided with elongated apertures 26 which serve as handles allowing the user to easily grasp and pick up the organizer.

The organizer as described above generally conforms to the construction of the standard postal tray. The dimensions of the tray may be approximately 14" wide by 25" long by 6½" high. In a preferred embodiment, the tray is fabricated from a suitable light weight material such as a coated corrugated fiber or plastic material.

As has been discussed above, the problem with conventional postal trays is that they are satisfactory when the tray is substantially full. However, as mail items are removed, the remaining items will tend to fall in a flattened condition on the bottom of the tray. The present invention provides an arrangement in which a retainer may be moved as mail items are removed in a direction to maintain the remaining mail in a generally upright position compacting the items between the retainer and an end wall of the organizer.

Accordingly, the bottom of the tray is provided with a track 40 which is preferably an extruded plastic member which extends from the inner side of wall 18 longitudinally at an intermediate location between the side walls 14 and 16. The track may extend the entire length of the bottom 22 of the organizer tray to end wall 20 or may terminate spaced from the end wall 20 as seen in FIG. 2.

Figure 3:
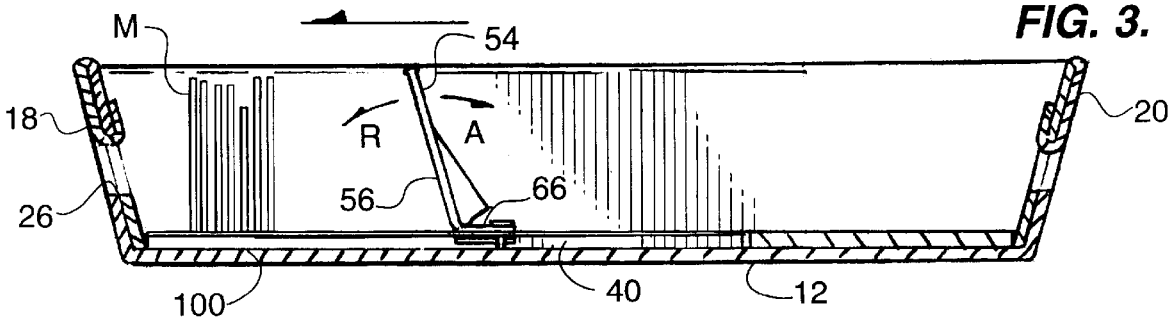
FIG. 3 is a longitudinal cross sectional view of the organizer.

As best seen in FIG. 3, the track includes a pair of upstanding spaced-apart webs 42, 44. A planar base 46 extends between the lower ends of webs 42, 44. The base 46 is secured to the interior of the bottom wall 22 by suitable means such as an adhesive. The track base may extend transversely beyond the webs 42, 44 for strength and to reinforce the tray or receptacle structure. Longitudinal reinforcing ribs 45 may also be provided on the base. The upper ends of webs 42, 44 each carry an inwardly extending flange 42A, 44A, respectively. The track slidably receives the retainer 50.

Figure 1:
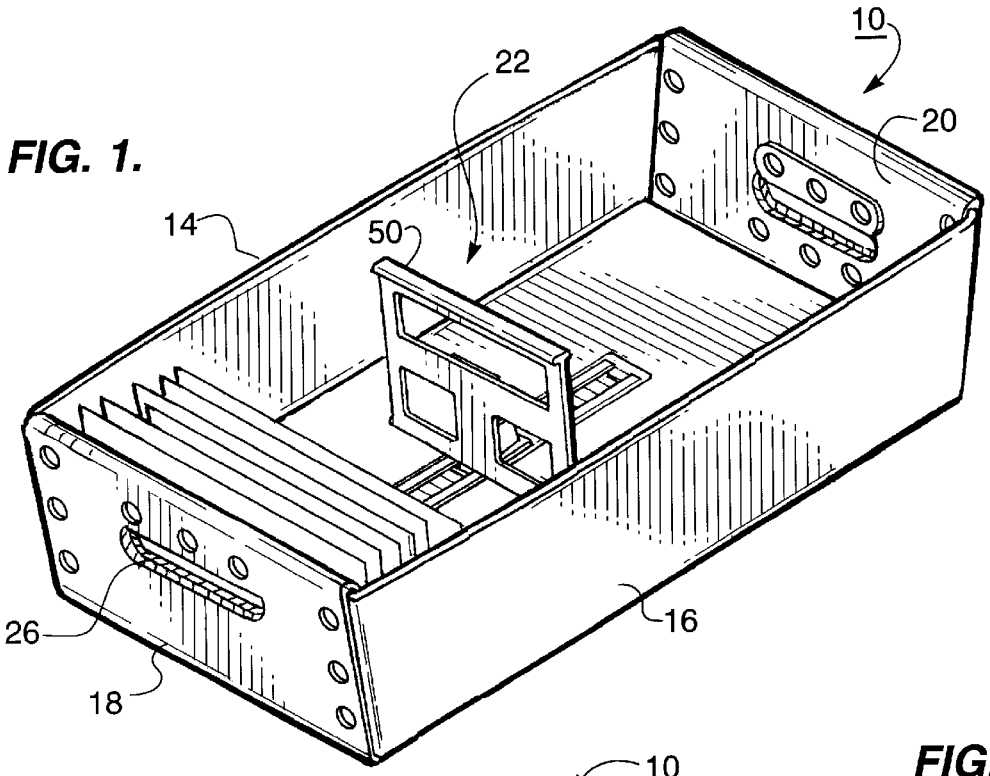
FIG. 1 is a perspective view of the postal organizer of the present invention.
Figure 2:
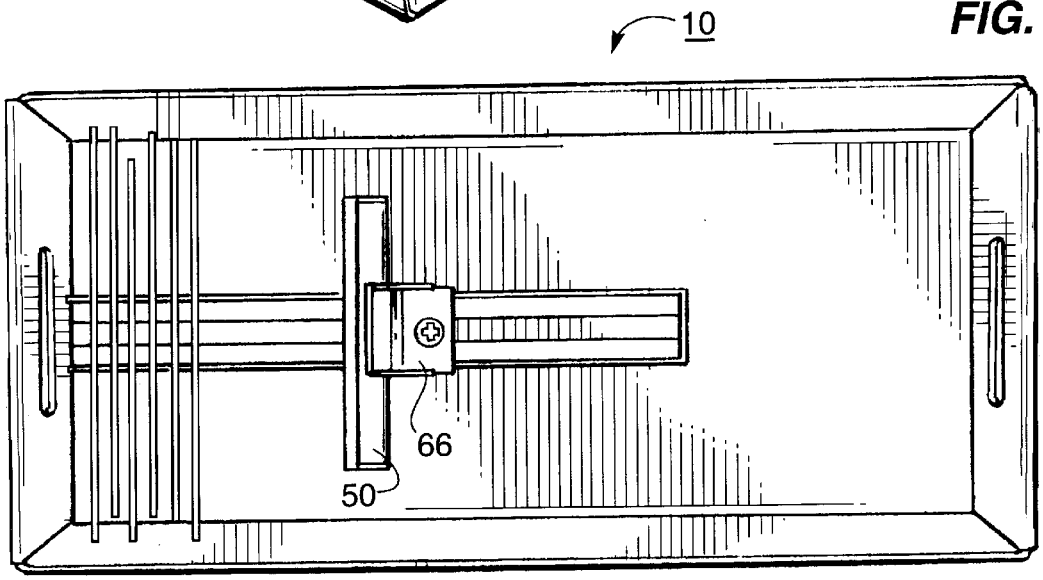
FIG. 2 is a top view of the organizer of the present invention.
Figure 4:
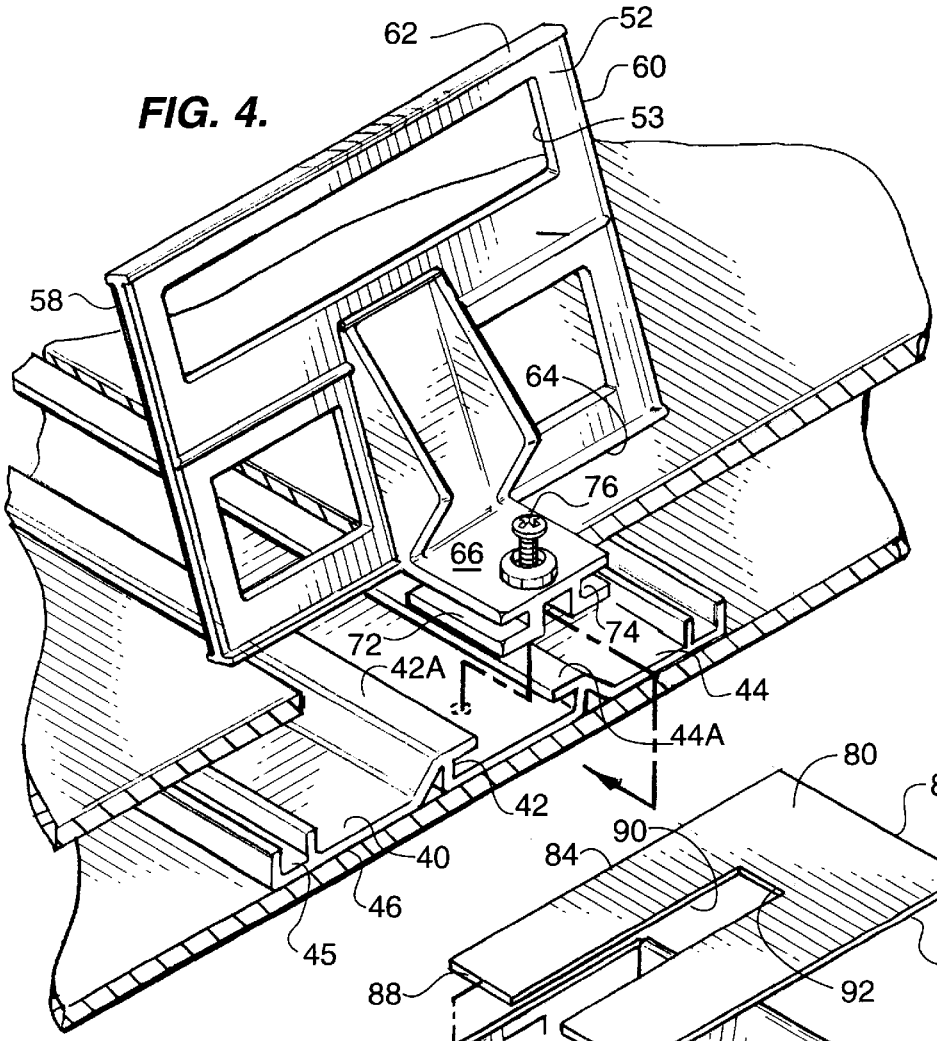
FIG. 4 is an enlarged detail view of the slide and track.

The retainer is best seen in FIGS. 2 and 4 and includes a panel 52 having opposite surfaces 54, 56 with cut-outs 53 for reduced weight and to provide a convenient grip. The panel is shown as rectangular having opposite edge 58 and 60 and upper edge 62 and bottom edge 64. The configuration of the retainer 50 generally conforms to the cross-sectional configuration of the mail receiving compartment of the tray and may be somewhat narrower.

A foot 66 extends from the lower end of the retainer at an intermediate location. A slide 70 projects from the underside of the foot 66. The slide 70 defines slots 72 and 74 which, as best seen in FIG. 4, receives the inwardly extending flanges 42A and 44A so that the retainer is slidably restrained within the track. An adjustable stop 76 depends from the end of the foot 66.

It will be seen that the retainer 50 is angularly disposed with respect to foot 66. The surface 56 forms an acute angle with respect to the bottom of the tray while surface 54 forms an obtuse angle. Surface 56 is maintained against the items such as mail "M" within the tray. In this way, the mail items within the tray will apply a slight force in the direction of the arrow "A" against surface 56. This force produces a slight moment which will cause the foot 66 to pivot slightly downwardly into engagement with the track. This slight moment will be sufficient so as to frictionally restrain the retainer from unwanted sliding motion. To release the retainer 50 to move it in either direction, the user will simply grasp the upper end of the retainer 50 applying a slight force in the opposite direction as shown by the arrow "R" which will pivot the foot 66 out of frictional engagement with the track allowing the retainer to be freely moved. In this way, the user can easily adjust the position of the retainer to accept more mail or maintain the existing or remaining mail items in an upright position as items are removed. The retainer is preferably molded from a suitable plastic material such as a light weight plastic such as acrylic, PVC or polyethylene.

Figure 5:
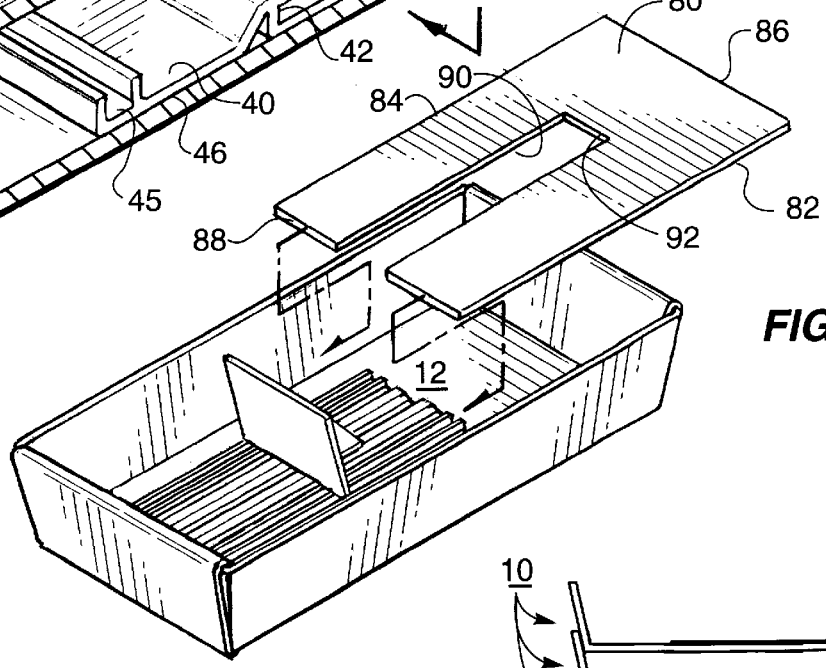
FIG. 5 is an exploded perspective view.

As pointed out above, the present invention lends itself to incorporation in existing mail trays. To facilitate the adaptation of the present invention to conventional mail trays, it is preferred that a false bottom 80 be positioned within the tray overlying the bottom 12. Referring to FIG. 5, the false bottom 80 has opposite sides 82, 84 and opposite ends 86, 88 which conform to the interior dimensions of the lower part of the mail receiving compartment 22. An elongated slot 90 is provided within the false bottom which slot overlies the track 40. Preferably the slot terminates at a location 92 short of the end of the false bottom. The termination of the slot at this location prevents the slide from being fully extended to the end wall 20 as the stop 76 will engage the end 92 of the slot.

Once the mail is sorted into the tray, the postal carrier will move the retainer to a location to maintain the mail in an upright position. As mail items are removed as the carrier proceeds along his or her route, the retainer can easily be manually moved toward end wall 18 as the volume of mail "M" within the tray decreases. This is accomplished by simply applying a slight rotative manual force in the direction indicated by the arrow "R" to the upper edge of the retainer freeing it so that it will easily slide. Once the retainer is moved to a new position, the carrier will release the force and the slight moment applied by the remaining mail will return the divider to a frictionally fixed position.

As shown in FIG. 6, the organizer of the present invention lends itself to being stacked. To nest or stack the trays, the retainer 15 is moved to a position immediately adjacent end 18 and the trays may then be conveniently stacked.

FIG. 3 also shows the addition of an optional biasing spring 100 extending in track 40 between the retainer and the end wall 18 which will serve to assist in maintaining the retainer in a snug position against the items between the retainer and the end wall. The spring will exert a force normally urging the retainer leftward as seen in FIG. 3.

It will be seen from the foregoing, the present invention provides a light weight, versatile, highly effective postal tray. It will be obvious to those skilled in the art to make various changes, alterations and modifications to the invention described herein. To the extent such changes, alterations and modifications do not depart from the spirit and scope of the appended claims. They are intended to be encompassed therein.

I claim:

1. An organizer for receiving articles comprising:

(a) a tray having a bottom, opposite sides and opposite front and rear ends and having an open top defining an article-receiving compartment, said tray being a light weight non-metal material;

(b) a track extending longitudinally along said bottom at least partway between the opposite ends, said track having a surface;

(c) slide means moveable along said track, said slide means having a foot extending toward said rear end and pivotal to bring said foot into engagement with one of said track surface on said tray bottom; and (d) a retainer panel on said slide having first and second surfaces, said first surface facing said front end of said tray to retain mail items there between, said first surface forming an acute angle with respect to the bottom whereby mail items will apply a force against the first surface causing said foot to pivot to said first position to restrain said slide; and (e) whereby said slide and retainer may be released for movement along said track by application of a manual force to the retainer in a direction toward said first end to cause said foot to pivot to a second position.

2. The article organizer of claim 1 wherein said tray is a corrugated material.

3. The article organizer of claim 1 wherein said track is an extruded plastic member.

4. The article organizer of claim 1 further including stop means associated with said foot for limiting the sliding movement of said retainer.

5. The article organizer of claim 1 wherein said sides and ends of said track are angularly disposed with respect to said bottom.

6. The article organizer of claim 1 further including a false bottom overlying said tray bottom.

7. The article organizer of claim 1 wherein said tray is a postal tray.

8. The article organizer of claim 1 further including spring means extending between said retainer and one end to apply a biasing force to said retainer urging it toward said one end.

9. A portable organizer for receiving mail articles comprising:

(a) a tray having a bottom, opposite sides and opposite front and rear end and having an open top defining a mail article receiving compartment, said tray being formed of a light weight, non-metal material;

(b) a track extending longitudinally along said bottom from said front end at least partway toward said rear end, said track having a surface;

(c) a slide moveable along said track surface, said slide having a foot extending toward said rear end of said tray and pivotal to a first position to bring said foot into engagement with one of said track surface on said tray bottom;

(d) a retainer on said slide having opposite front and rear surfaces, said front surface facing said front end of said tray to receive mail articles there between, said front surface forming an acute angle with respect to the tray bottom whereby mail articles will apply a force against said first surface to pivot said foot to said first position to restrain said slide;

(e) a floor panel overlying said bottom;

(f) whereby said slide and retainer may be released for movement along said track by application of a manual force applied to the retainer in a direction toward said front end to cause said foot to pivot to a second position.

* * * * *